US009101255B2

(12) United States Patent
Ak

(10) Patent No.: US 9,101,255 B2
(45) Date of Patent: Aug. 11, 2015

(54) DISHWASHER WITH IMPROVED DRYING AND INSULATION PROPERTIES

(75) Inventor: Gokhan Ak, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 422 days.

(21) Appl. No.: 13/520,173

(22) PCT Filed: Dec. 16, 2010

(86) PCT No.: PCT/EP2010/069985
§ 371 (c)(1),
(2), (4) Date: Oct. 17, 2012

(87) PCT Pub. No.: WO2011/080113
PCT Pub. Date: Jul. 7, 2011

(65) Prior Publication Data

US 2013/0032180 A1 Feb. 7, 2013

(30) Foreign Application Priority Data

Dec. 31, 2009 (TR) ..... a 2009 10101

(51) Int. Cl.
*A47L 15/42* (2006.01)
*A47L 15/48* (2006.01)

(52) U.S. Cl.
CPC ..... *A47L 15/4217* (2013.01); *A47L 15/488* (2013.01)

(58) Field of Classification Search
None
See application file for complete search history.

(56) References Cited

FOREIGN PATENT DOCUMENTS

| | | | |
|---|---|---|---|
| EP | 0753282 | A1 | 1/1997 |
| EP | 1055389 | A2 | 11/2000 |
| EP | 1690489 | A2 | 8/2006 |

*Primary Examiner* — Jason Ko
(74) *Attorney, Agent, or Firm* — Venjuris, P.C.

(57) ABSTRACT

The dishwasher (1) of the present invention comprises a washing tub (2) wherein items to be washed are placed, a body (4) having two side walls (3) enclosing the washing tub (2), a fan (5) providing the vapor in the washing tub (2) to be discharged to the outside by sucking it during the drying step and thus providing the washed dishes to dry, a water receptacle (6) wherein the water received from the mains is stored before passing to the regeneration unit.

7 Claims, 4 Drawing Sheets

DISHWASHER WITH IMPROVED DRYING AND INSULATION PROPERTIES

Figure 1:
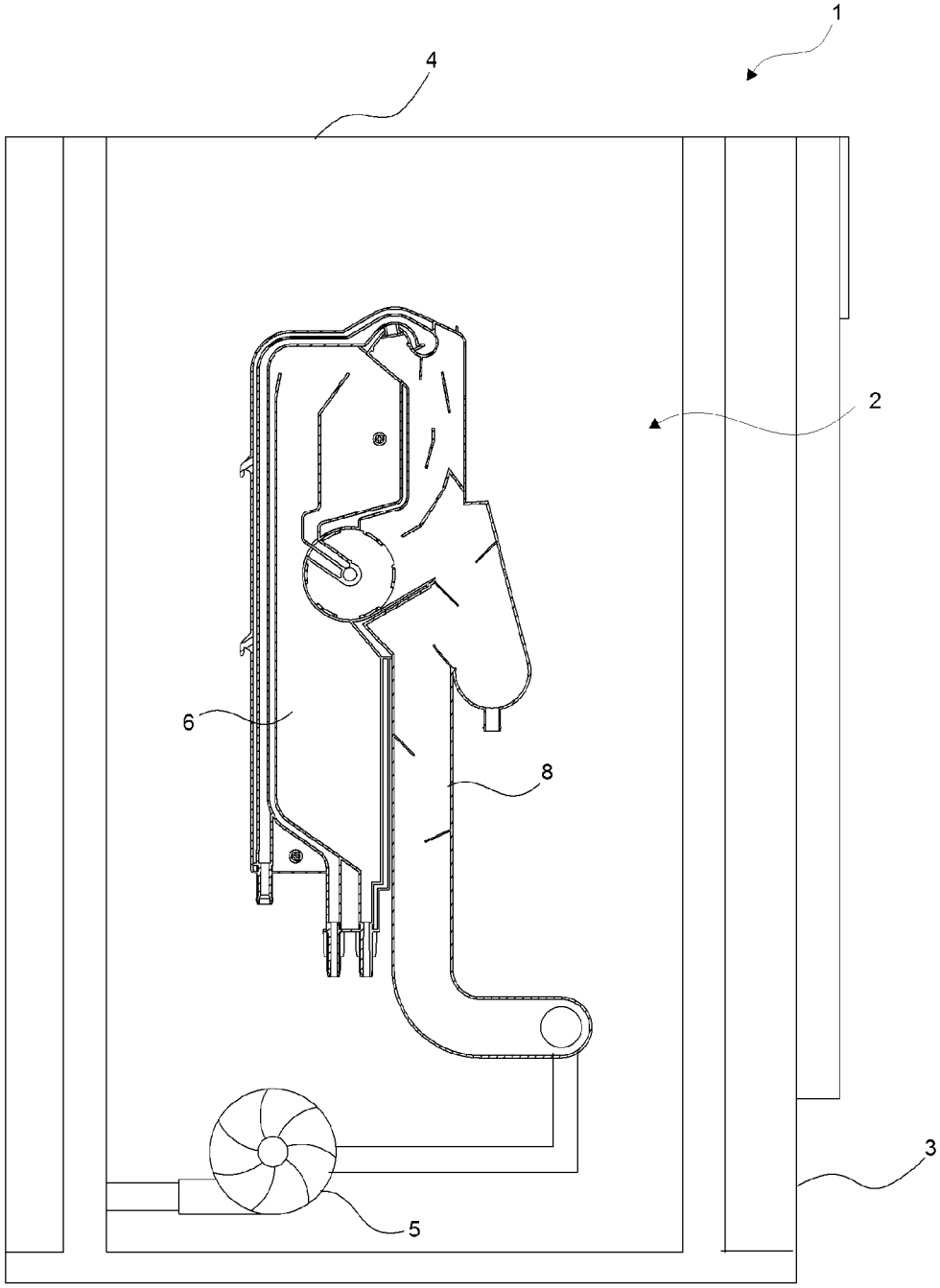

The present invention relates to a dishwasher the sound and heat insulation of which is improved.

In dishwashers, the water received from the mains during washing is directed to the regeneration unit by being passed through the tank called the water receptacle, and to the washing tub from there. The water receptacle is disposed between the washing tub and the side wall of the body. By means of the air break disposed on the water receptacle, the air contained in water is provided to be discharged outside, the water droplets remaining in the water receptacle are drained into the washing tub by means of the water receptacle leakage hole opening to inside of the washing tub.

In the dishwashers, furthermore, a fan suction hole facing to the inside of the washing tub and an air channel with one end connected to the fan suction hole and the other end to the fan are disposed. The air channel is disposed between the washing tub and the side wall of the body.

In the state of the art, the water receptacle is disposed on one side of the body and the air channel on the other side of the body. Problems are encountered in sound and heat insulation since these two components being disposed on two separate side walls of the body prevent the use of felt in the places these components are located. Furthermore, not being able to use felt in the places these components are disposed results in energy losses.

The aim of the present invention is the realization of a dishwasher the sound and heat insulation of which is improved.

The dishwasher realized in order to attain the aim of the present invention, explicated in the first claim and the respective claims thereof, comprises a water receptacle and an air channel integrated with the water receptacle. The water receptacle provides the water received from the mains to be stored before being delivered to the regeneration unit and the air of water to be broken by the air breaks disposed therein. The air channel provides the vapor aspirated from the washing tub during the drying step to reach the fan and to be discharged outside. The water receptacle and the air channel are disposed between the washing tub and the same side wall such as to be integrated to each other. Accordingly, one of the side walls is provided to remain empty. Thus, the sound and heat insulation of the dishwasher is improved by entirely cladding bitumen and felt on the side wall on which no component is disposed. On the other hand, the energy consumption of the dishwasher is decreased by improving the heat insulation and saving in energy is provided.

The water receptacle and the air channel open into the washing tub by means of a shared hole. The hole not only provides the water leakage occurring in the air break of the water receptacle to be discharged into the washing tub but also allows the vapor in the washing tub to be aspirated by the fan during the drying step. The water receptacle and the air channel functioning by using a shared hole eliminate the need for opening a second hole on the washing tub.

In an embodiment of the present invention, the air channel is attached to the water receptacle by plastic welding. An integrated water receptacle—air channel structure is formed by the water receptacle and the air channel being connected to one another by using an inexpensive and simple method like welding.

In another embodiment of the present invention, the water receptacle and the air channel are produced in integrated form. By means of the integrated production, the problems of leakage that may arise during connecting the water receptacle and the air channel are prevented.

In another embodiment of the present invention, a set is provided in the water receptacle in order to prevent the water drops remaining in the water receptacle that cannot pass into the regeneration unit from passing into the air channel. The set prevents water drops from escaping into the air channel by directing the water drops remaining in the water receptacle towards the water receptacle thus providing them to be discharged into the washing tub by means of the hole. Thus, the fan is protected by preventing passage of water drops through the air channel to the fan.

By means of the present invention, the water receptacle and the air channel are integrated with one another and disposed on only one side wall of the body. The water receptacle and the air channel open into the washing tub by using a shared hole. Consequently, the need for opening separate holes on the washing tub for each one of the water receptacle and the air channel is eliminated. Moreover, by disposing both of the components on the same side wall, the other side wall is provided to be entirely clad by the insulation materials. Consequently, sound and heat insulation of the dishwasher is improved.

A dishwasher realized in order to attain the aim of the present invention is illustrated in the attached figures, where:

FIG. 1—is the schematic view of a dishwasher.

Figure 2:
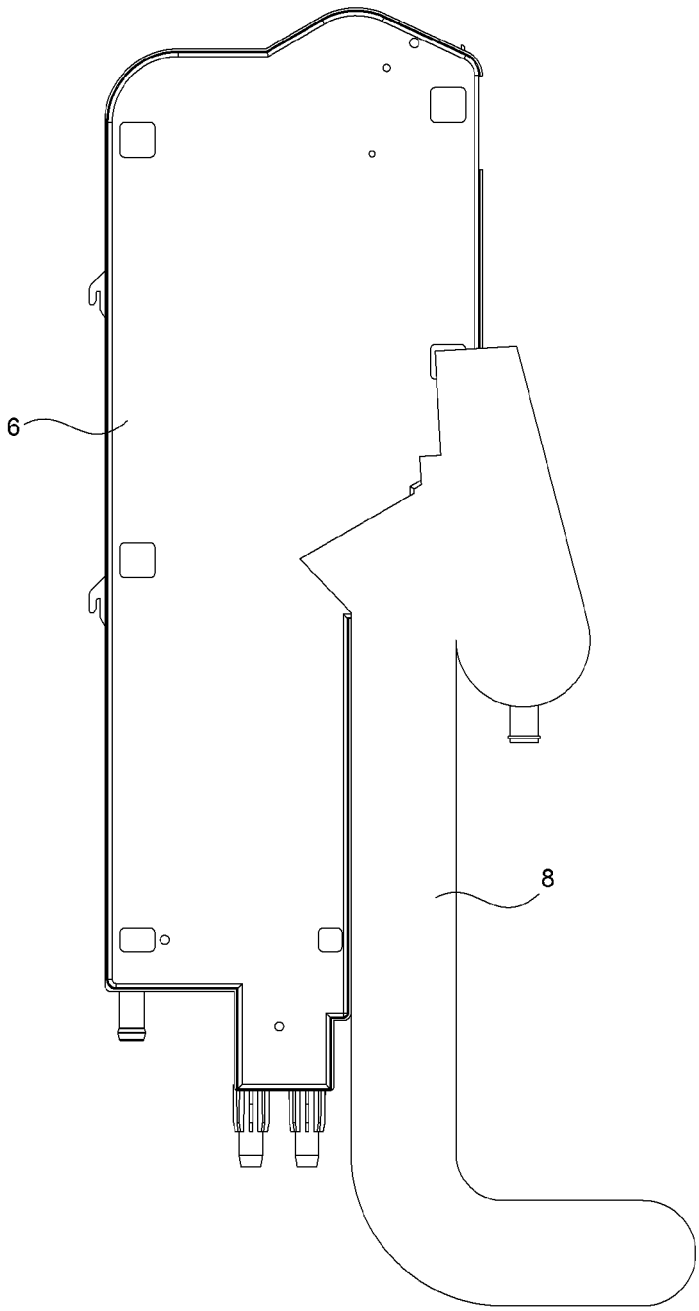

FIG. 2—is the schematic view of a water receptacle and an air channel.

Figure 3:
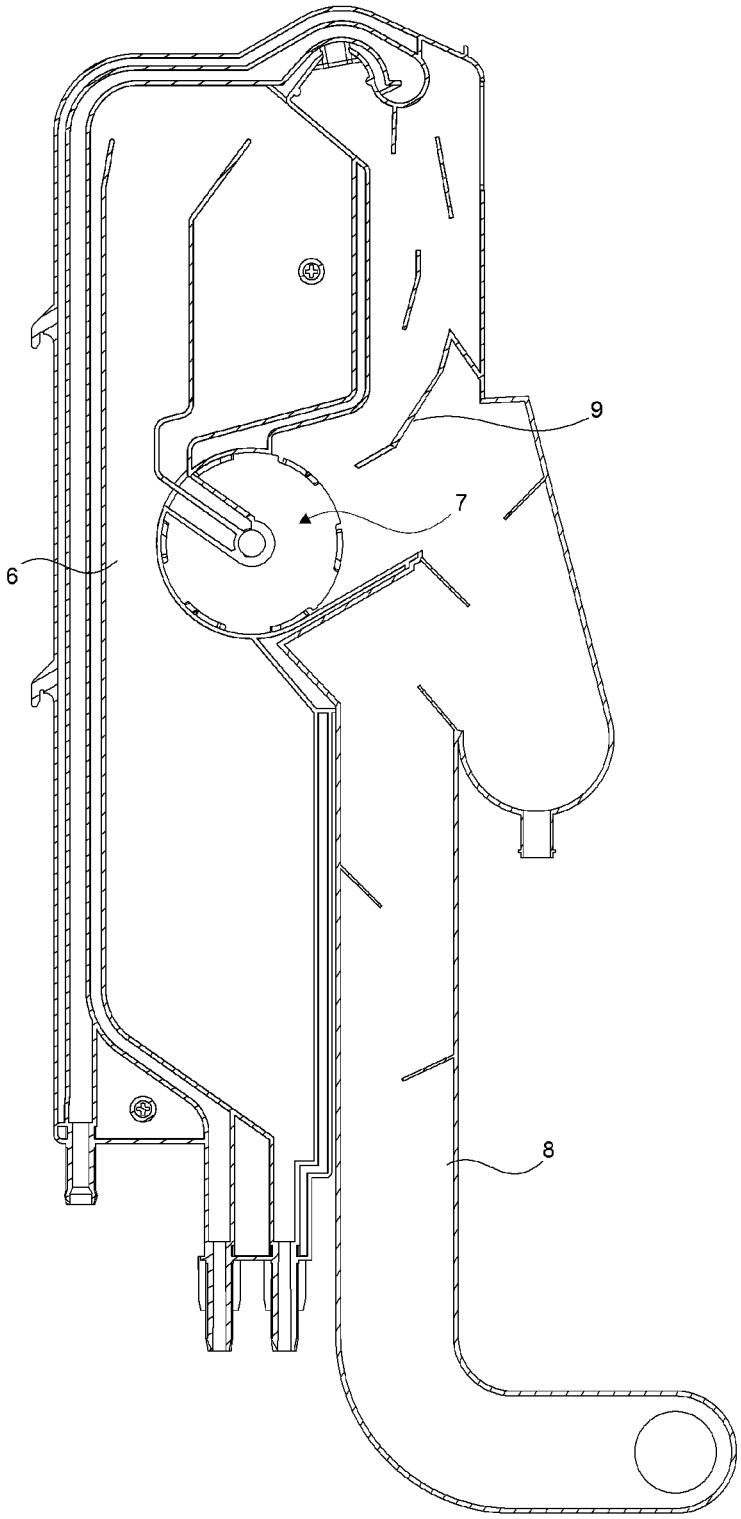

FIG. 3—is the cross sectional view of a water receptacle and an air channel.

Figure 4:
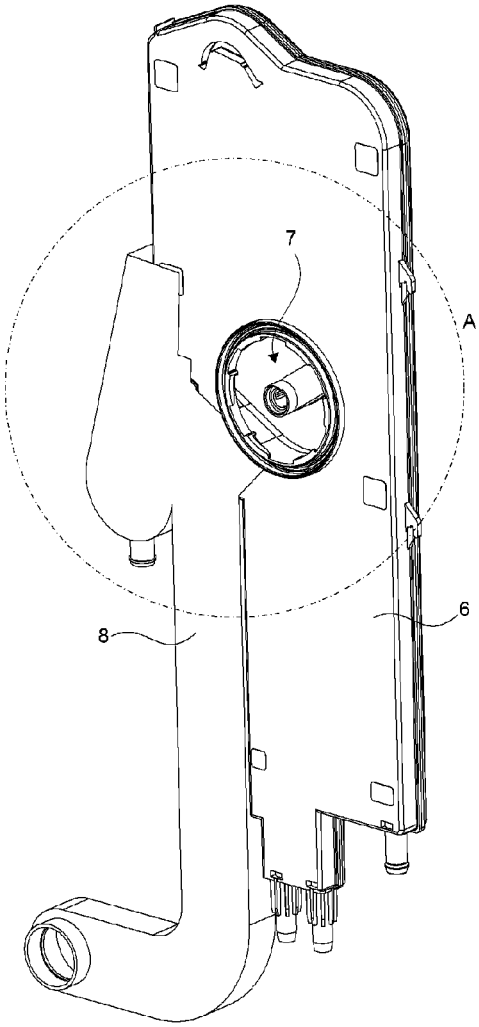

FIG. 4—is the perspective view of a water receptacle and an air channel.

Figure 5:
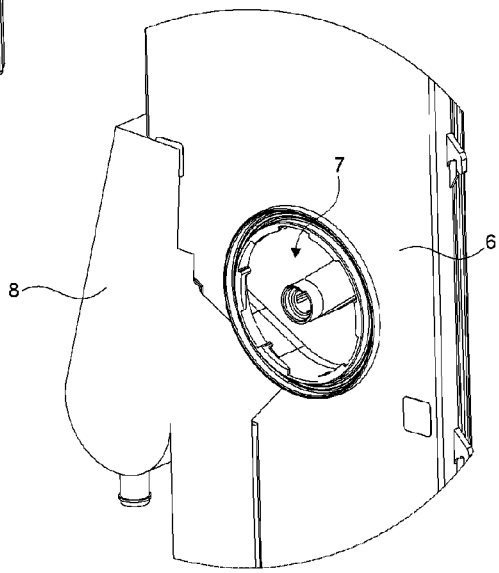

FIG. 5—is the perspective view of detail A in FIG. 4.

The elements illustrated in the figures are numbered as follows:

1. Dishwasher
2. Washing tub
3. Side wall
4. Body
5. Fan
6. Water receptacle
7. Hole
8. Air channel
9. Set The dishwasher (1) of the present invention comprises a washing tub (2) wherein items to be washed are placed, a body (4) having two side walls (3) enclosing the washing tub (2), a fan (5) providing the vapor in the washing tub (2) to be discharged to the outside by sucking it during the drying step and thus providing the washed dishes to dry, a water receptacle (6) wherein the water received from the mains is stored before passing to the regeneration unit and an air channel (8) integrated with the water receptacle (6), delivering the vapor sucked from the washing tub (2) to the fan (5) during the drying step (FIG. 1, FIG. 2, FIG. 3 and FIG. 4).

The water receptacle (6) and the air channel (8) are disposed between the washing tub (2) and one of the side walls (3).

Consequently, the sound and heat insulation performance of the dishwasher (1) is increased by cladding insulation materials like bitumen and felt on the side wall (3) on which no component is disposed. Improving heat insulation of the dishwasher (1) also provides decrease in energy consumption. In addition to these, disposing the water receptacle (6) and the air channel (8) on the same side wall (3) enables the volume of the washing tub (2) to increase.

The dishwasher (1) comprises a hole (7) arranged on the water receptacle (6), opening into the washing tub (2) and the air channel (8) integrated with the water receptacle (6) such that one end thereof opens into the hole (7), delivering the vapor sucked from the washing tub (2) to the fan (5) by means of the hole (7) during the drying step.

The water received from the mains during washing is delivered to the regeneration unit by being passed through the water receptacle (6). The air of the water received from the mains is broken by means of the air breaks disposed on the water receptacle (6) before being delivered to the regeneration unit. Water leakages that occur in the air break are discharged into the washing tub (2) by means of the hole (7). The hole (7) provides the connection between the water receptacle (6) and the washing tub (2). Furthermore, following the delivery of water in the water receptacle (6) to the washing tub (2) by being passed through the regeneration unit, the water droplets remaining in the water receptacle (6) are also discharged into the washing tub (2) by means of the hole (7).

The communication of the air channel (8) with the washing tub (2) is also provided by the hole (7). The air channel (8) provides the connection between the hole (7) and the fan (5). During the drying step, the vapor in the washing tub (2) is sucked by the fan (5) by means of the hole (7) and reaches the fan (5) by being conveyed with the air channel (8). The washed dishes are provided to be dried by the vapor sucked by the fan (5) being discharged to the outside.

The water receptacle (6) and the air channel (8) integrated to each other are disposed on a single side wall (3) such that a shared hole (7) is used. Thus, the need for disposing one of these components on the other side wall (3) and forming any hole (7) on the washing tub (2) for providing interactivity with the washing tub (2) is eliminated.

In an embodiment of the present invention, the air channel (8) is attached to the water receptacle (6) by plastic welding. Thus, the water receptacle (6) and the air channel (8) produced separately are attached to each other by plastic welding. The water receptacle (6) and the air channel (8) attached to each other open to the washing tub (2) by using the same hole (7).

In an embodiment of the present invention, the water receptacle (6) and the air channel (8) are attached to each other such that the hole (7) remains almost in the middle (FIG. 4 and FIG. 5). Thus, a more compact integrated structure is attained.

In another embodiment of the present invention, the water receptacle (6) and the air channel (8) are produced such as to be one-piece. Thus, the problems of leakage that may arise during connecting the water receptacle (6) and the air channel (8) are prevented.

In another embodiment of the present invention, the dishwasher (1) comprises a set (9) disposed inside the water receptacle (6), that prevents the water drops remaining in the water receptacle (6) from escaping into the air channel (8) (FIG. 3). The set (9) is in the form of a wall disposed at a point near the connection region of the water receptacle (6) and the air channel (8) and directing the water drops towards the water receptacle (6). The water drops remaining in the water receptacle (6) are provided to be discharged into the washing tub (2) through the hole (7) by means of the set (9). Consequently, the fan (5) is protected by preventing the water drops from escaping into the air channel (8).

By means of the present invention, the water receptacle (6) and the air channel (8) are provided to be integrated to each other and to function by using a shared hole (7). Consequently, the sound and heat insulation performance of the dishwasher (1) is increased by cladding insulation materials like bitumen and felt on one of the side walls (3) that does not need the disposal of any components thereon.

It is to be understood that the present invention is not limited to the embodiments disclosed above and a person skilled in the art can easily introduce different embodiments. These different embodiments should also be considered within the scope of the claims of the present invention.

The invention claimed is:

1. A dishwasher (1) comprising a washing tub (2) wherein items to be washed are placed, a body (4) having two side walls (3) enclosing the washing tub (2), a fan (5) providing the vapor in the washing tub (2) to be discharged to the outside by sucking it and thus providing the washed dishes to dry during the drying step, a water receptacle (6) wherein the water received from mains is stored before passing to a regeneration unit, and an air channel (8) integrated with the water receptacle (6), delivering the vapor sucked from the washing tub (2) to the fan (5) during the drying step and wherein the water receptacle (6) and the air channel (8) open into the washing tub (2) by means of sharing a hole (7).

2. The dishwasher (1) as in claim 1, wherein the hole (7) arranged on the water receptacle (6), opening into the washing tub (2) and the air channel (8) integrated with the water receptacle (6) such that one end thereof opens to the hole (7), delivering the vapor sucked from the washing tub (2) by means of the hole (7) to the fan (5) during the drying step.

3. The dishwasher (1) as in claim 1 or 2, wherein the water receptacle (6) and the air channel (8) disposed between the washing tub (2) and one of the side walls (3).

4. The dishwasher (1) as in claims 1 or 2, wherein the air channel (8) attached to the water receptacle (6) by plastic welding.

5. The dishwasher (1) as in claims 1 or 2, wherein the water receptacle (6) and the air channel (8) that are attached to each other side by side such that the hole (7) remains almost in the middle.

6. The dishwasher (1) as in claims 1 or 2, wherein the air channel (8) that is produced such as to be one-piece with the water receptacle (6).

7. The dishwasher (1) as in claims 1 or 2, further comprising a set (9) disposed inside the water receptacle (6), preventing the water drops remaining in the water receptacle (6) from escaping into the air channel (8).

* * * * *